US007197985B2

(12) United States Patent
Markel et al.

(10) Patent No.: US 7,197,985 B2
(45) Date of Patent: Apr. 3, 2007

(54) HIGH-PRESSURE EXPLOSIVE RETENTION DEVICE

(75) Inventors: Daniel C. Markel, Pearland, TX (US); Larry W. Phillips, Alvin, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 151 days.

(21) Appl. No.: 10/708,220

(22) Filed: Feb. 17, 2004

(65) Prior Publication Data

US 2005/0178550 A1 Aug. 18, 2005

(51) Int. Cl.
*F42B 14/00* (2006.01)

(52) U.S. Cl. ..... 102/524; 102/275.1

(58) Field of Classification Search ..... 102/275.1, 102/275.2, 275.7, 275.8
See application file for complete search history.

(56) References Cited

U.S. PATENT DOCUMENTS 3,929,072 A 12/1975 Zapf
4,742,773 A 5/1988 Bartholomew et al.
4,920,883 A * 5/1990 Barker ..... 102/202.5
4,998,477 A * 3/1991 Barker ..... 102/275.6
5,009,163 A 4/1991 Robins et al.
5,123,356 A * 6/1992 Brooks et al. ..... 102/275.12
5,155,293 A 10/1992 Barton
5,327,835 A 7/1994 Adams et al.
5,499,581 A 3/1996 Sutula, Jr.
5,524,547 A 6/1996 Kelly et al.
6,295,912 B1 10/2001 Burleson et al.
6,397,752 B1 6/2002 Yang et al.

* cited by examiner

*Primary Examiner*—Michael J. Carone
*Assistant Examiner*—Gabriel J. Klein
(74) *Attorney, Agent, or Firm*—Trop, Prunner & Hu, P.C.; Bryan P. Galloway; Jaime A. Castano

(57) ABSTRACT

An apparatus and method for reliably activating explosives includes providing one or more housing sections that define a sealed space. A first explosive element is provided in the sealed space, and a second explosive element has a first portion inside the sealed space, and a second portion outside the sealed space exposed to outside pressure. A gripping mechanism grips a surface of the second explosive element to maintain a position of the second explosive element that is exposed to the outside pressure in an axial direction of the second explosive element.

22 Claims, 2 Drawing Sheets

HIGH-PRESSURE EXPLOSIVE RETENTION DEVICE

BACKGROUND OF INVENTION

In completing a well, perforations are often extended into the formation surrounding a wellbore to enable communication of well fluids between the formation and the wellbore. Perforation is accomplished by use of perforating guns that are run into the wellbore from a well surface. Such perforating guns typically include shaped charges that, when initiated, produce perforating jets that cut through a casing or liner and extend perforating tunnels into the surrounding formation. The shaped charges are typically connected to a detonating cord, which is in turn connected to a detonation assembly (or firing head). To activate the perforating gun, an input signal (such as an electrical signal, optical signal, pressure pulse signal, mechanical signal, or another signal) is provided to the detonation assembly, which causes initiation of the detonating cord. A detonation wave traveling down the detonating cord causes detonation of the shaped charges.

Explosives can also be used to perform other well operations, such as setting packers, activating pipe cutters, and so forth. An issue associated with initiating explosives in a wellbore is the presence of a high hydrostatic pressure inside the wellbore, particularly when detonation assemblies to initiate the explosives are exposed to the wellbore pressure. Hydrostatic pressures of as high as 20,000 psi (or even higher) in a wellbore is not uncommon. The presence of high pressure in a wellbore can make explosive detonation less reliable, and the ballistic transfer between multiple explosive elements less reliable. In the presence of high pressure, explosive elements such as a detonating cord or a booster explosive are compacted, which causes the explosive elements to become desensitized.

In conventional detonating assemblies of perforating guns, a sealed housing is often provided, with the sealed housing containing a detonator. The inner chamber of the sealed housing is at ambient pressure, which allows reliable initiation of the explosive in the detonator that is located in the sealed housing. With a conventional sealed housing, a pressure barrier is usually used between the detonator and another explosive component (such as a booster explosive or a detonating cord) that is to be initiated by the detonator. The pressure barrier prevents entry of wellbore pressure into the inner chamber of the sealed housing. The pressure barrier often is in the form of a thin wall of the housing. Initiation of the detonator causes the barrier to be ruptured to enable the detonation to be transferred from the detonator to the explosive component on the other side of the barrier. The pressure barrier tends to reduce the explosive energy that can be directed from the detonator to the explosive element through the barrier. As a result, the transfer of explosive energy from the detonator to the other side of the barrier may not reliably detonate the explosive element.

SUMMARY OF INVENTION

In general, methods and apparatus are provided to increase reliability of explosive transfer from one explosive element to another explosive element in the presence of high pressure. For example, an apparatus includes one or more housing sections that provide a sealed space. A first explosive element is in the sealed space. A second explosive element has a first portion in the sealed space, and a second portion outside the sealed space exposed to outside pressure. A gripping mechanism grips a surface of the explosive element to maintain a position of the second explosive element that is exposed to the outside pressure in an axial direction of the second explosive element.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; "upstream" and "downstream"; "above" and "below"; and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

Figure 1:
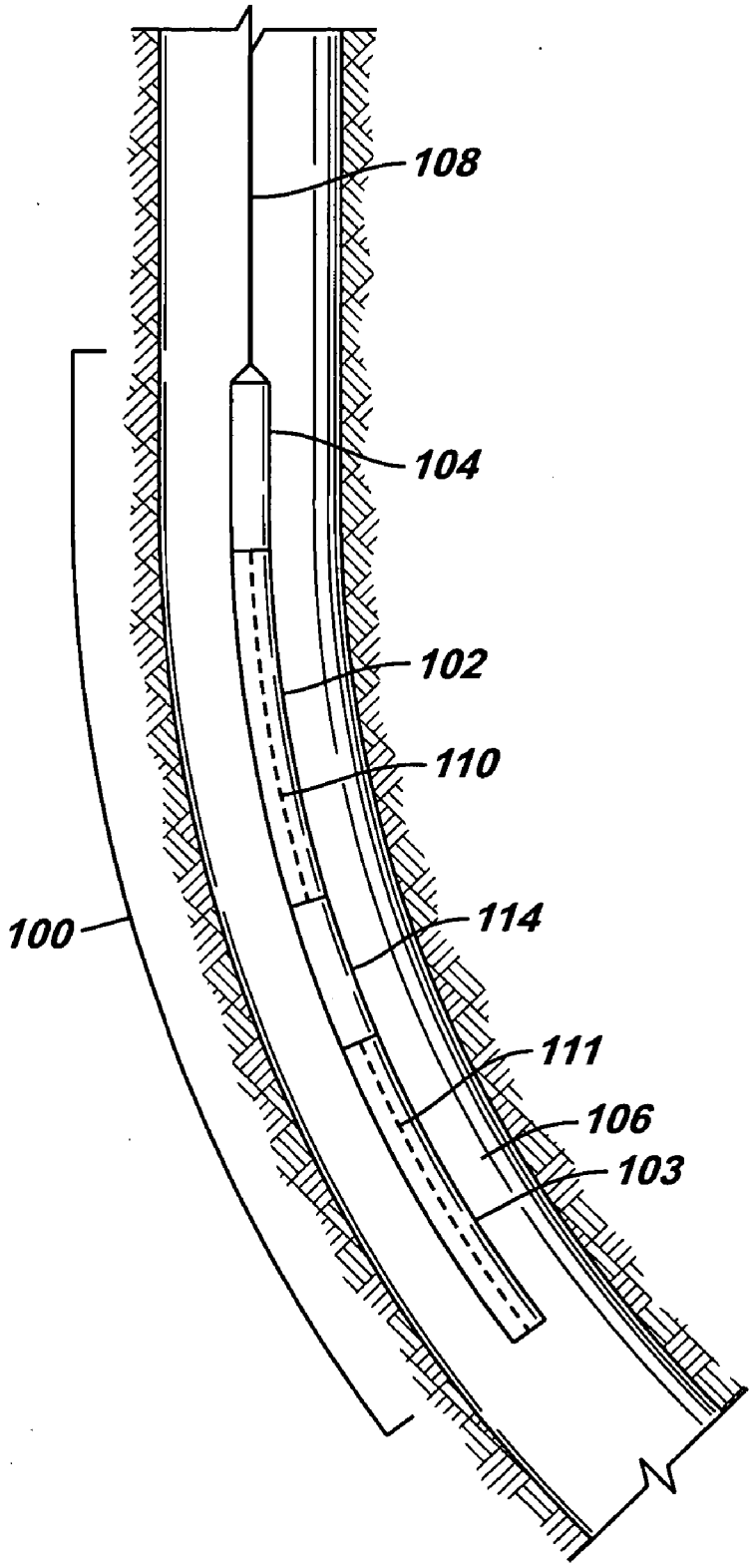
FIG. 1 illustrates a tool string positioned in a wellbore, the tool string incorporating an embodiment of the invention.

FIG. 1 illustrates a perforating gun string 100 that includes perforating guns 102 and 103 and a detonator assembly 104 according to some embodiments coupled to the uppermost perforating gun 102. The perforating gun string 100 is carried into a wellbore 106 on a carrier structure 108, which can be a wireline, slickline, coiled tubing, and so forth. The detonator assembly 104 initiates a detonating cord 110 in the perforating gun 102 to fire the perforating gun 102. The detonation wave in the detonating cord 110 is transferred to a detonating cord 111 in the perforating gun 103 by a ballistic transfer unit 114.

In other embodiments, instead of the two perforating guns 102 and 103 shown in FIG. 1, only one perforating gun or more than two perforating guns can be used. Also, in alternative embodiments, multiple detonator assemblies 104 can be used in a tool string.

The detonator assembly 104 according to some embodiments receives an input signal from a well surface, which input signal can be in the form of an electrical signal transmitted over electric conductor(s) in the carrier structure 108, an optical signal transmitted over a fiber optic cable in the carrier structure 108, pressure pulse signals transmitted through the wellbore 106, mechanical stimuli in the form of mechanical forces applied on the carrier structure 108, and so forth.

Although described in the context of a tool string including perforating guns, the detonator assembly 104 can be used in tool strings including other types of tools. For example, such other tools include tools to set packers, activate pipe cutters, set valves, and so forth. The detonator assembly 104 can also be used in tools for other applications, such as seismic, mining, military, and other applications.

At least one explosive element of the detonator assembly 104 is exposed to wellbore pressure, which can be quite high. An explosive element is exposed to pressure when any portion of the explosive element is in contact with fluid at the pressure. To assure reliable detonation of the detonator assembly 104 in the presence of the wellbore pressure, the detonator assembly 104 provides a sealed space (with one or more housing sections) in which a first explosive element (e.g., a detonator explosive) is located. The detonator assembly 104 also includes a second explosive element (e.g., a detonating cord) having a first portion in the sealed space and a second portion outside the sealed space and exposed to outside pressure such as the high wellbore pressure. To enhance reliable detonation of the second explosive element, a gripping mechanism is used to grip a surface of the second explosive element to maintain an axial position of the second explosive element. Effectively, the gripping mechanism anchors the second explosive element in position in the detonator assembly. The gripping mechanism reduces compaction of the second explosive element to avoid desensitization of the second explosive element. In some implementations, the detonator assembly also includes additional explosive element(s), such as a booster explosive.

Figure 2:
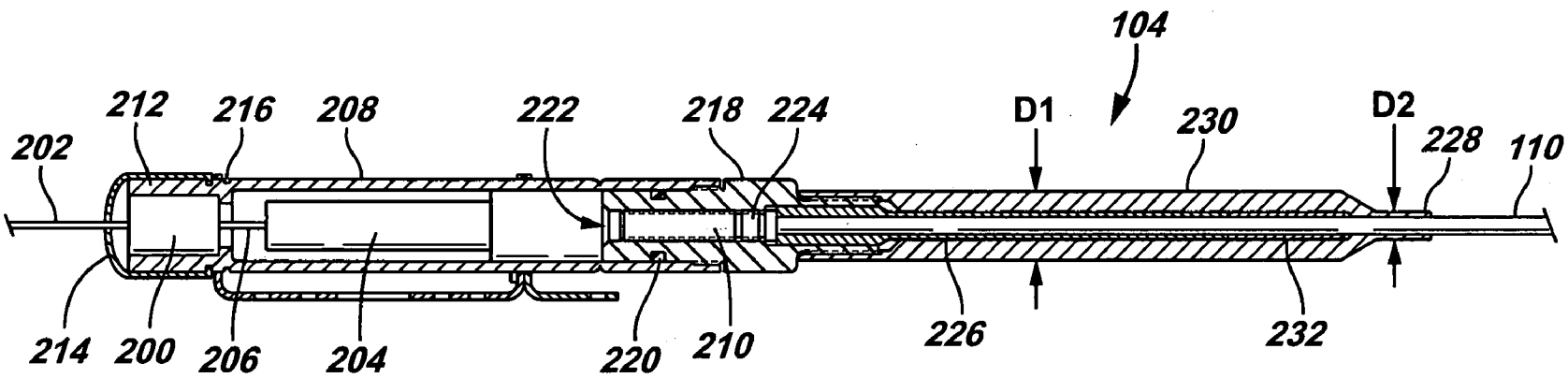
FIG. 2 is a longitudinal sectional view of a detonator assembly according to an embodiment of the invention.

The detonator assembly 104, as shown in FIG. 2, includes an electronic module 200 that is connected to an electrical cable 202 to receive electrical signals. Alternatively, instead of the module 200 being connected to an electrical cable 202, the module 200 can be communicated to another type of communications channel (such as a fiber optic cable). Another implementation of the module 200 includes a module capable of receiving and processing pressure pulse stimuli, mechanical stimuli, and other input stimuli.

The module 200 is in turn connected to a detonator 204. In response to input signals received over the electrical cable 202, the module 200 provides an activation signal over a cable 206 to the detonator 204. The electronic module 200, the detonator 204, and the electrical cable 206 are contained within a chamber of a housing 208 that is sealed from wellbore fluids. The detonator assembly 104 is designed to function reliably at high pressure, such as high hydrostatic pressures that are present in the wellbore 106 (FIG. 1). In some cases, the hydrostatic pressure in the wellbore 106 can be as high as 20,000 psi (sometimes even higher). In the presence of such high pressures, a mechanism is provided in the detonator assembly 104 to enable reliable activation of explosive elements contained within the detonator assembly 104. Such explosive elements include the detonator 204, a booster explosive 210, and the detonating cord 110.

As further shown in FIG. 2, the upper portion 212 of the housing 208 is covered by a cap 214. The cap 214 is sealably connected (by a seal 216, e.g., an O-ring seal) to the upper portion 212 of the housing 208.

The lower portion of the housing 208 is connected to a booster housing 218, which has an inner bore in which the booster explosive 210 is positioned. The connection between the housing 208 and the booster housing 218 is a sealed connection provided by a seal 220.

The upper portion 222 of the booster explosive 210 is in contact with the lower end of the detonator 204. The lower portion 224 of the booster explosive 210 is contacted to the upper end of the detonating cord 110. Initiation of the detonator 204 causes an explosive energy to be transferred from the detonator 204 to the booster explosive 210, with further explosive energy transferred to the detonating cord 110. In accordance with some embodiments of the invention, a pressure barrier is not needed between the detonator 204 and the booster explosive 210, as is conventionally done. As a result, the amount of explosive energy that can be transferred by the detonator 204 to the booster explosive 210 is substantially greater than conventional designs where a pressure barrier is interposed between the detonator and booster explosive.

The lower portion of the booster housing 218 is sealably connected to a boot 230 which can be formed of an elastomer or any other elastic material. The boot 230 has a first portion with an outer diameter D1 and a second narrower portion 228 with a diameter D2, where D2 is less than D1. The boot 230 has an inner bore through which the detonation cord 110 extends. The narrower portion 228 of the boot 230 provides a high-stress area where better contact is provided between the inner surface of the narrower boot portion 228 and the outer surface of the detonating cord 110. The high-stress area provided by the narrower boot portion 228 is designed to remove any voids between the narrower portion 228 and the detonating cord 110 to prevent the entry of wellbore fluids into the sealed space inside of the detonator assembly 104.

In another embodiment, instead of the boot 230, an elastomer tape can be used instead.

The detonator assembly 104 also includes a grip tube 226 that extends longitudinally from the lower end 224 of the booster explosive 210 to an upper end of a crimping shell 232. Both the grip tube 226 and the crimping shell 232 are located instead the bore of the boot 230. Each of the grip tube 226 and crimping shell 232, each of which can be formed of metal or other hard material, includes an inner bore through which the detonating cord 110 passes.

The inner surface of the grip tube 226 is roughened (e.g., threaded) to enable gripping engagement with the outer surface of the detonating cord 110. The crimping shell 232 also has a roughened inner surface to grip the outer surface of the detonating cord 110. The crimping shell 232 is designed to hold the axial position of the detonating cord 110 at low pressures. The grip tube 226 is designed to collapse radially inwardly in the presence of high wellbore pressure. The radially inward collapse of the grip tube 226 enables tight gripping of the detonating cord 110 by the grip tube 226 when the detonator assembly 104 is run into the wellbore 106. Thus, in the wellbore 106, the grip tube 226 is able to maintain the axial position of the detonating cord 110 (maintain the position of the detonating cord 110 in the axial direction of the detonating cord 110) even in the presence of high hydrostatic pressure acting on the exposed portion of the detonating cord 110. The gripping or anchoring performed by the grip tube 226 in the presence of high outside pressure prevents the detonating cord 110 from being compacted into the booster explosive 210.

In the detonator assembly 104 depicted by FIG. 2, the housings 208 and 218 and the boot 230 are housing sections that define a sealed space in which the detonator 204, booster explosive 210, and a first portion of the detonating cord 110 are located. Whereas the boot 230 is formed of an elastic material to enable a reliable sealing contact between the boot 230 and the detonating cord 110, the housings 208 and 218 are formed of a hard material such as metal or other like material. The second portion of the detonating cord 110 is exposed to outside pressure, such as wellbore hydrostatic pressure.

The gripping mechanism in the arrangement of FIG. 2 includes the grip tube 226 and crimping shell 232. The gripping mechanism is effectively activated by the presence of high pressure, which acts on the boot 230 to cause the collapse of the grip tube 226 radially inwardly to grip the detonating cord 110.

The sealed inner space provided by the boot 230 and housings 218 and 208, which is sealed from the external pressure, allows the detonator 204, booster explosive 210, and the upper portion of the detonating cord 110 to be initially at ambient pressure. As a result, the transfer of explosive energy from the detonator 204 to the booster explosive 210, and from the booster explosive 210 to the detonating cord 110, is reliable since the detonation occurs at ambient pressure.

In an alternative embodiment, the upper portion of the detonating cord 110 can be contacted directly to the detonator 204, with the booster explosive 210 omitted. The same concepts can be applied to detonator assemblies used in other applications.

While the invention has been disclosed with respect to a limited number of embodiments, those skilled in the art will appreciate numerous modifications and variations therefrom. It is intended that the appended claims cover such modifications and variations as fall within the true spirit and scope of the invention.

The invention claimed is:

1. An apparatus comprising:

one or more housing sections providing a sealed space;

a first explosive element in the sealed space;

a cable;

a component to provide a signal over the cable to the first explosive element to detonate the first explosive element;

a second explosive element having a first portion inside the sealed space, and a second portion outside the sealed space exposed to outside pressure, the first explosive element to initiate the second explosive element without presence of a pressure barrier between the first and second explosive elements; and a gripping mechanism to grip a surface of the second explosive element to maintain a position of the second explosive element that is exposed to the outside pressure in an axial direction of the second explosive element, wherein an inner surface of a first one of the one or more housing sections is contacted to the second explosive element to provide sealing engagement between the first housing section and the second explosive element.

2. The apparatus of claim 1, wherein the first housing section comprises a boot formed of an elastic material, the boot contacted to the second explosive element.

3. The apparatus of claim 2, wherein the elastic material comprises an elastomer.

4. The apparatus of claim 2, wherein the one or more housing sections further comprise a hard housing section to house the first explosive element.

5. The apparatus of claim 4, wherein the first explosive element in the hard housing section comprises a detonator explosive.

6. The apparatus of claim 5, wherein the second explosive element comprises a detonating cord.

7. The apparatus of claim 6, further comprising a booster explosive provided in the sealed space and ballistically connected between the detonator explosive and the detonating cord.

8. The apparatus of claim 2, wherein the gripping mechanism comprises a grip tube having an inner space through which the second explosive element extends, the grip tube having a roughened inner surface to grip an outer surface of the second explosive element.

9. The apparatus of claim 8, wherein the gripping mechanism further comprises a crimping shell to grip the second explosive element.

10. The apparatus of claim 9, wherein the crimping shell is adapted to anchor the second explosive element at a first pressure, and the grip tube is adapted to anchor the second explosive element at a second pressure, the second pressure greater than the first pressure.

11. The apparatus of claim 10, wherein the grip tube is adapted to collapse at greater than a predetermined pressure, wherein collapse of the grip cube causes the grip tube to grip the second explosive element.

12. The apparatus of claim 9, wherein the boot comprises an inner chamber in which the grip tube and crimping shell are located.

13. The apparatus of claim 9, wherein the boot comprises an inner chamber in which the grip tube and crimping shell are located.

14. The apparatus of claim 1, further comprising a well tool adapted to be activated by detonation of the first and second explosive elements.

15. The apparatus of claim 1, further comprising a perforating gun to be activated by detonation of the first and second explosive elements.

16. An apparatus comprising:

one or more housing sections providing a sealed space;

a first explosive element in the sealed space;

a cable;

a component to provide a signal over the cable to the first explosive element to detonate the first explosive element;

a second explosive element having a first portion inside the sealed space, and a second portion outside the sealed space exposed to outside pressure, the first explosive element to initiate the second explosive element without presence of a pressure barrier between the first and second explosive elements;

a gripping mechanism to grip a surface of the second explosive element to maintain a position of the second explosive element that is exposed to the outside pressure in an axial direction of the second explosive element; and a third explosive element between the first and second explosive elements, wherein the third explosive element is contacted to the first explosive element, and the third explosive element is contacted to the second explosive element.

17. The apparatus of claim 16, wherein the component comprises an electronic module.

18. The apparatus of claim 17 wherein the electrical module is responsive to input signals provided over an input cable.

19. The apparatus of claim 16, wherein the cable comprises an electrical cable.

20. The apparatus of claim 16, wherein the first explosive element comprises a detonator, the second explosive element comprises a detonating cord, and third explosive element comprises a booster explosive between the detonator and the detonating cord, the booster explosive contacted to the detonator and contacted to the detonating cord.

21. An apparatus comprising:

one or more housing sections providing a sealed space;

a detonator in the sealed space;

a booster explosive contacted to the detonator in the sealed space;

a detonating cord contacted to the booster explosive, wherein a first portion of the detonating cord is in the sealed space, and a second portion of the detonating cord is outside the sealed space for exposure to outside pressure, wherein an inner surface of one of the one or more housing sections is contacted to the detonating cord to provide sealing engagement between the one housing section and the detonating cord; and a gripping mechanism to grip a surface of the detonating cord to maintain a position of the detonating cord in the axial direction of the detonating cord.

22. The apparatus of claim 21, wherein the booster explosive is contacted to the detonator without presence of a barrier between the booster explosive and the detonator.

* * * * *